US005184995A

United States Patent [19]

Kuchenbecker

[11] Patent Number: 5,184,995

[45] Date of Patent: Feb. 9, 1993

[54] CONTAINERS AND BLANKS WITH A CURLED EDGE AND METHOD OF MAKING SAME

[75] Inventor: Morris W. Kuchenbecker, Neenah, Wis.

[73] Assignee: James River Corporation of Virginia, Richmond, Va.

[21] Appl. No.: 839,674

[22] Filed: Feb. 21, 1992

Related U.S. Application Data

[63] Continuation of Ser. No. 636,149, Dec. 31, 1990, abandoned.

[51] Int. Cl.[5] ..... B31B 3/14

[52] U.S. Cl. ..... 493/79; 493/158

[58] Field of Search ..... 493/62, 74, 79, 80, 493/102, 104, 108, 109, 140, 156-159; 229/126, 132, 135, 198.2, 905

[56] References Cited

U.S. PATENT DOCUMENTS

| | | | |
|---|---|---|---|
| 1,115,060 | 10/1914 | Eaton | 229/132 |
| 1,435,384 | 11/1922 | Fleischer | 493/103 X |
| 2,266,948 | 12/1941 | Barbieri . | |
| 2,272,920 | 2/1942 | Merta . | |
| 2,286,692 | 6/1942 | Smith . | |
| 2,288,896 | 7/1942 | Fink . | |
| 2,473,836 | 6/1949 | Wixon et al. . | |
| 2,473,840 | 6/1949 | Amberg . | |
| 2,541,905 | 2/1951 | Amberg . | |
| 2,641,827 | 6/1953 | Carpenter | 493/109 X |
| 2,755,983 | 7/1956 | Ringler . | |
| 2,979,224 | 4/1961 | Henchert | 493/102 X |
| 3,065,677 | 11/1962 | Loeser . | |
| 3,182,882 | 5/1965 | Aellen, Jr. et al. . | |
| 3,195,426 | 7/1965 | Bauer | 493/109 X |
| 3,410,939 | 11/1968 | Driza et al. | 493/214 X |
| 3,487,443 | 12/1969 | Wise et al. . | |
| 3,547,011 | 12/1970 | Farquhar . | |
| 3,728,002 | 4/1973 | Zacks | 229/125.08 X |
| 4,264,316 | 4/1981 | Knudsen | 493/103 |
| 4,295,838 | 10/1981 | Richards et al. . | |
| 4,373,928 | 2/1983 | Horton . | |
| 4,396,380 | 8/1983 | Sanchez . | |
| 4,526,563 | 7/1985 | Froom | 493/156 X |
| 5,029,749 | 7/1991 | Aloisi . | |

FOREIGN PATENT DOCUMENTS

| | | |
|---|---|---|
| 2926967 | 1/1981 | Fed. Rep. of Germany . |
| 8606045 | 10/1986 | PCT Int'l Appl. . |
| 958388 | 5/1964 | United Kingdom . |

*Primary Examiner*—Bruce M. Kisliuk
*Assistant Examiner*—John A. Marlott
*Attorney, Agent, or Firm*—Sixbey, Friedman, Leedom & Ferguson

[57] ABSTRACT

A blank cutting technique in a process for manufacturing containers such as paperboard cups, canisters and cartons provides a flaired edge which, in one embodiment, forms a precurl to facilitate the formation of a completed brim curl and in another embodiment, is used to provide a flaired edge on a lid flap of a carton. In the latter case, the flaired edge which is created assists in insertion of the lid flap into the carton opening and creates an improved seal. In the blank cutting technique, stock material is positioned on a die cutting bed across a stepped portion. The stock material is cut along a cutting line offset from and substantially parallel to the stepped portion and against a lower surface of the die cutting bed defined by the stepped portion during the cutting operation, whereby the flaired edge is formed.

12 Claims, 8 Drawing Sheets

CONTAINERS AND BLANKS WITH A CURLED EDGE AND METHOD OF MAKING SAME

This application is a continuation of Ser. No. 636,149, filed Dec. 12, 1990, now abandoned.

BACKGROUND OF THE INVENTION

This invention relates to containers such as paperboard containers and blanks for forming the same, as well as methods for forming such containers and blanks. More specifically, the invention relates to constructions and manufacturing methods for containers, e.g., paperboard containers, provided with a curled or flaired edge.

In the prior art, it is known to form a container such as a paperboard cup from a blank of suitable stock material. In such methods, it is often desirable to provide an upper edge of the cup with a curled edge. Such a curled edge is commonly referred to as a brim curl and is desirable to reinforce the container and to provide a smooth edge which facilitates drinking from the cup. In the brim curl forming processes of the prior art, various techniques for providing a curled brim are known. For example, in Amberg U.S. Pat. No. 2,541,905 and Loeser U.S. Pat. No. 3,065,677, a cup is maintained in a corresponding cavity of a female die. A male die is then moved into the female die and into engagement with the upper edge of the cup whereby complimentary surfaces of the male and female die cooperate to form a completely curled edge. In the Loeser technique, the male die is optionally spun around its axis as it is moved towards the female die in order to facilitate the curling operation.

Smith U.S. Pat. No. 2,286,692 illustrates another rim curling operation wherein a pair of grooved rolls are rotated about the periphery of the cup in order to form a rolled rim. This technique is useful for forming a rolled rim about a non-circular (elliptical) container.

A problem associated with the prior art techniques is that the walls of the container may buckle during the rim curling operation due to friction between the dies or rolls of the curling apparatus and the upper edge of the container. Such buckling can also occur due to slight misalignment of the dies or rolling apparatus relative to the container rim. For example, if the male die contacts the upper edge of the container at a surface of the male die which is perpendicular to the container wall, buckling is likely to occur. Such buckling prevents a satisfactory brim curl from being formed and results in material waste since a container with a buckled edge portion is no longer usable. This undesirable occurance being illustrated in FIGS. 6A and 6B.

The above-described problems are especially pronounced where the container being formed has linear edge portions. Such a container is typically formed using a grooved roll arrangement like that disclosed in the Smith patent or in a cold-forming operation where the dies are not rotated. Where grooved rolls are used to form the rim, when a linear edge portion is encountered, since the edge portion is parallel to the grooved roll, there is no transverse component of curling force imposed upon the rim due to the relative movement between the cup and grooved roll. Thus, it is more difficult to avoid buckling and, even if buckling is avoided, it is more difficult to form a complete curl, e.g., of at least 360 degrees. On the other hand, a similar difficulty is encountered if a cold-forming operation is used since spinning of the male die is not performed to facilitate the curling action.

Paperboard cartons for containing ice cream and the like are well known in the art. A typical construction comprises a carton formed from a paperboard blank having panels which form wall portions of the carton. Such cartons are typically rectangular in shape when formed and a flap arrangement is provided at one end of the carton for opening and closing the container. It is important with such containers to effect a tight seal between the closure flaps and the container in order to preserve the freshness of the ice cream or other perishable product contained therein against freezer burn. In the known carton constructions, one lid flap is typically provided which is hingedly movable to substantially cover an entire open end portion of the carton. In a closed position, the lid flap lies flat just fitting within the perimeter of the carton. Since the flap must sit just within the carton, it is necessary to dimension the lid flap slightly smaller than the internal dimension of the carton. This results in an imperfect seal. On the other hand, if the lid flap were not reduced in size, it would be difficult to properly position the lid flap within the carton. There undesirable shortcomings being illustrated in FIGS. 8A and 8B.

U.S. Pat. No. 3,547,011 issued to Farguhar discloses a paperboard container for use in convection ovens having a metalic foil inner layer for protecting the paperboard material. The container includes a concave rolled flange perimeter such that the foil layer protects the exposed edges of the paperboard material in order to keep these edges from being charred during cooking. While the flanged edge is formed during the formation of the blank used to form the resultant container, there are no additional manufacturing processes carried out with respect to the flange. This flange merely performs a protective function in the resultant container.

Accordingly, it can be seen that there is a need in the art for a manufacturing process which will provide a blank having a working surface which aids in the further manufacturing of a particular container.

SUMMARY OF THE INVENTION

It is, therefore, an object of the present invention to provide a solution to the above-described problems. In particular, the following are objects of the present invention.

It is an object of the present invention to produce a paperboard blank including a working surface, which surface aids in the further manufacturing of a particular container by bringing the working surface into contact with a mechanical contact surface to cause the contact surface to mechanically interact as desired with the working surface.

It is an object of the present invention to provide an improved method for forming a container with a brim curl, wherein buckling of the walls of the container during the brim-forming operation is avoided.

It is another object of the present invention to provide an improved method for forming a blank used to form a container with a brim curl.

It is a further object of the present invention to provide a method for forming, during a blank cutting operation, a pre-curl which assists in the brim forming operation.

It is a yet further object of the present invention to provide a technique for simultaneously cutting a blank and forming a pre-curled edge on a container which assists in final formation of a brim-curl, such that any additional pre-curling step may be avoided.

It is yet a further object of this second aspect of the invention to provide a method for forming a blank for a carton of the above-mentioned type.

In yet a third aspect of the present invention, it is an object to provide a paperboard container having a pre-curled perimeter with the precurled perimeter serving to form a working surface to aid in the sealing of a closure material over the container.

These and other objects are achieved by the present invention which, in a first aspect, comprises a method of forming a container with a brim curl, comprising the steps of cutting from stock material a blank for the container in a manner so as to create a pre-curled portion along at least one edge thereof; forming the container from the blank; and performing a final curling operation on the container to form a brim curl on an upper edge of the container corresponding to said at least one edge.

Still another aspect of the invention provides a method of making a blank for a closable paperboard carton, comprising the steps of cutting from stock material a blank for the carton in a manner so as to create an outwardly flaired edge along at least one side of a portion of the blank corresponding to a lid flap of the carton; and providing appropriate fold lines on the blank for forming the carton such that the flaired edge when positioned within the carton effectively seals the carton opening.

These and other objects and features of the present invention will become apparent and fully understood from the following detailed description of the preferred embodiments, taken together with the accompanying drawings.

DETAILED DESCRIPTION OF THE PREFERRED EMBODIMENTS

Figure 1A:
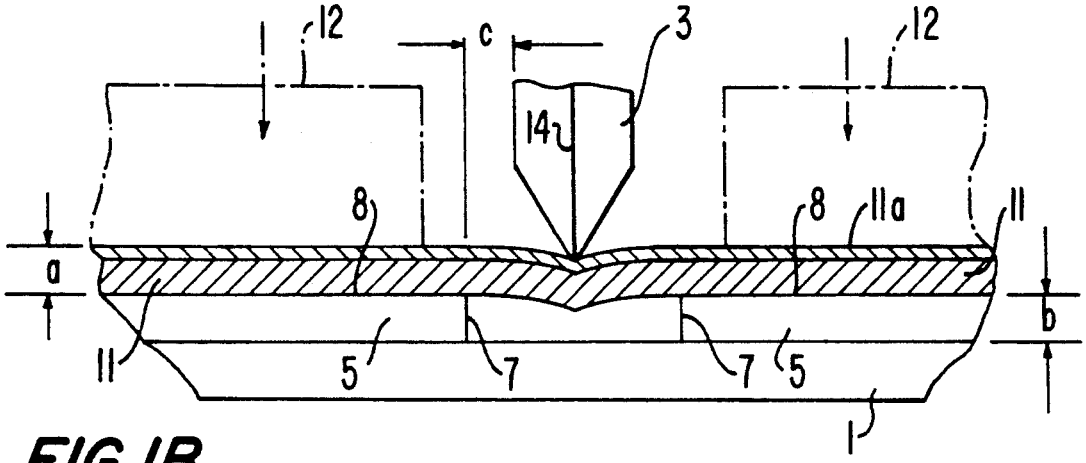
FIGS. 1A, 1B and 1C are schematic diagrams illustrating a cutting operation wherein a curl is provided along the edge of a blank during the cutting operation.
Figure 1B:
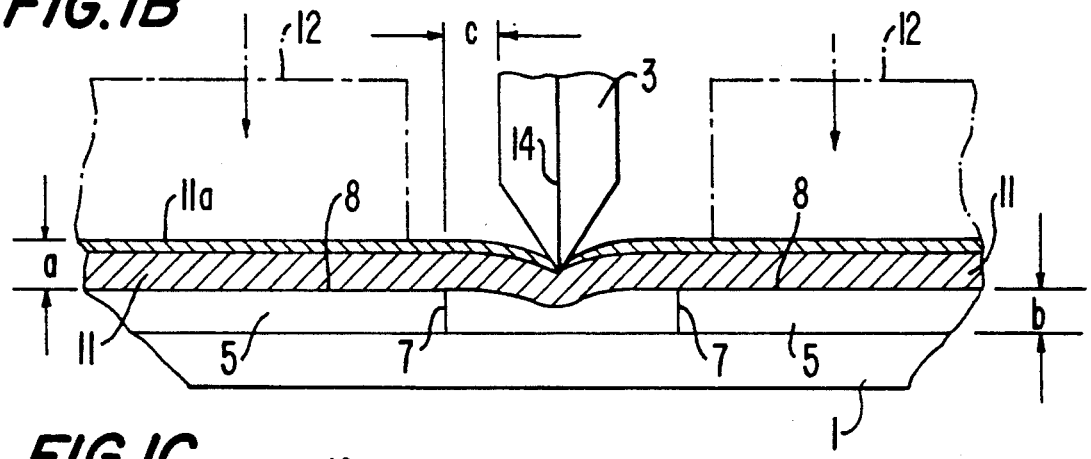
Figure 1C:
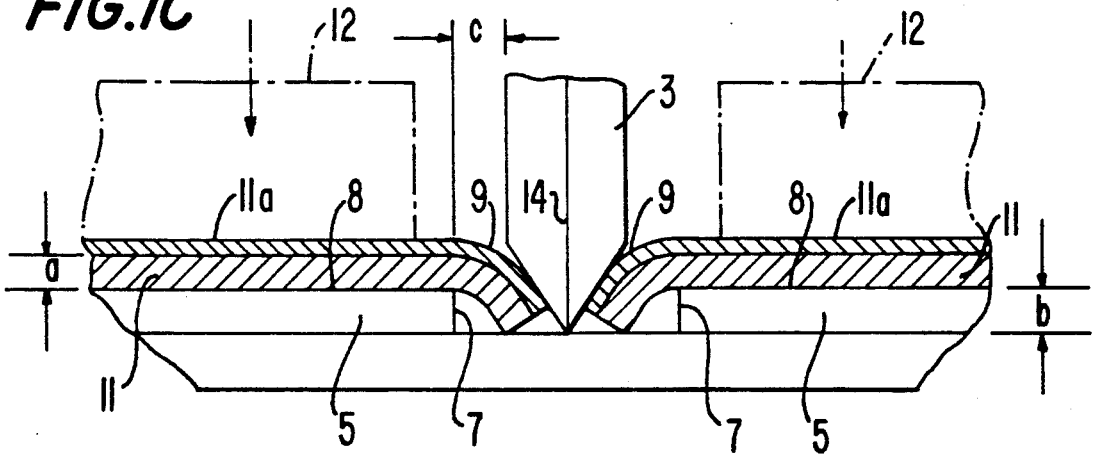
Figure 2:
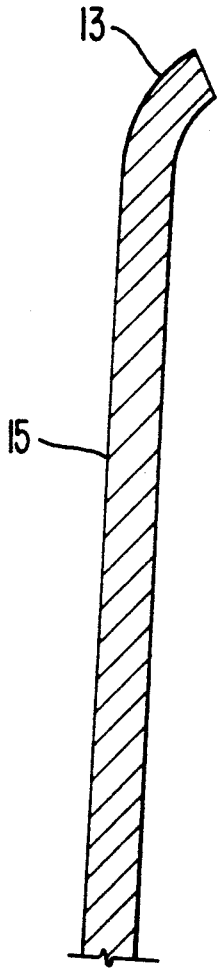
FIG. 2 is a partial, cross-sectional view of an upstanding container wall provided with a pre-curl in accordance with the present invention.
Figure 3:
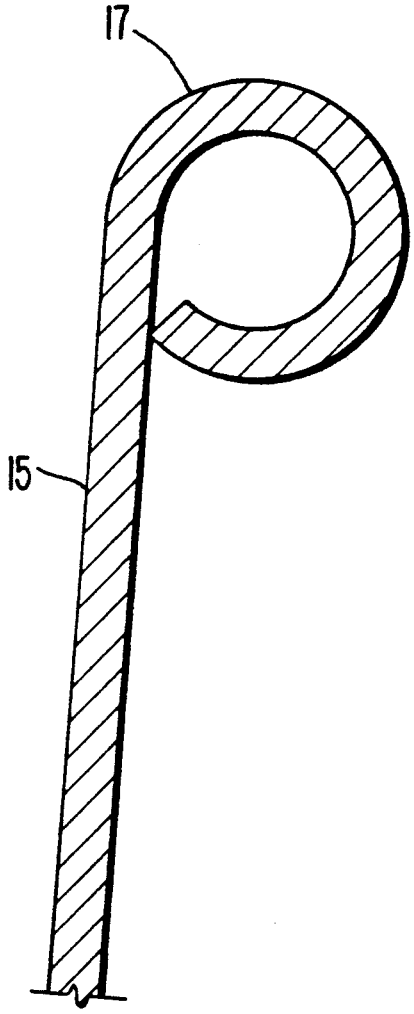
FIG. 3 is a partial, cross-sectional view of an upstanding container wall after the final brim curling operation.

FIGS. 1A–1C illustrate generally the blank cutting operation which may be performed as part of the process of making the paperboard containers illustrated in FIGS. 2–5, 9 and 11. References 1 and 3 depict, respectively, a steel bed and cutting knife of a die cutter of known construction (e.g., Thomson or Bobst type). Attached to steel bed 1 is one or more layers of counter material 5 for creating a stepped portion 7. In the blank cutting operation of the present invention, stock material 11 is positioned on the surface 8 of the counter 5 so that it extends across stepped portion 7. The blank 11 is preferably paperboard and may include a coating 11*a* of any known material. Cutting tool 3 is offset from stepped portion 7 by a predetermined amount depending on the desired result, as will be described in further detail hereinbelow. The cutting operation takes place against steel bed 1 in a line which parallels stepped portion 7. A flaired edge or precurl 9 is created during the cutting operation due to the cutting force exerted on stock material 11 and the offset of cutting tool 3. During the cutting operation, a hold down device 12 may be employed to hold the blank 11 in place.

Counter layer 5 may be of any suitable material. The important characteristic of the material is that it be able to withstand the cutting operation without deformation and be resistant to wear so that a sharp outer edge is maintained at stepped portion 7. The thickness of counter layer 5 will be accurately determined based upon the desired curvature of the precurl 9.

Figure 5A:
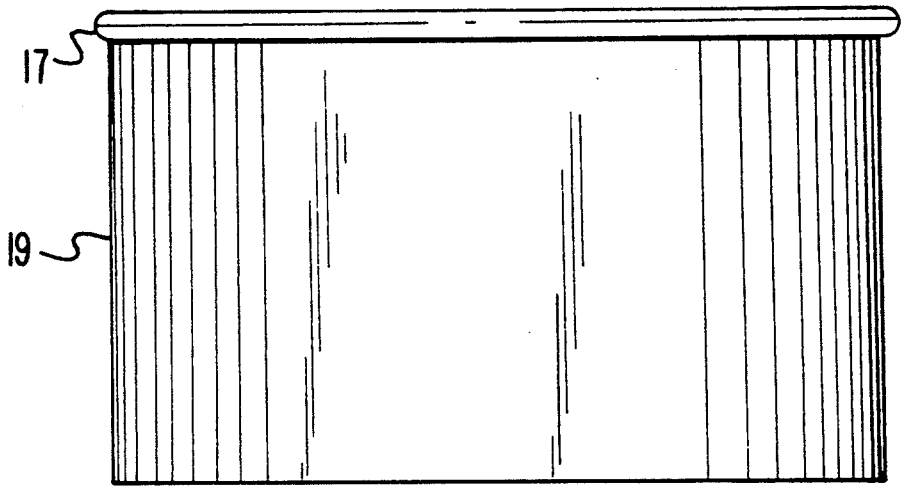
FIG. 5A illustrates a second type of container which may be provided with a brim curl in accordance with the present invention.
Figure 5B:
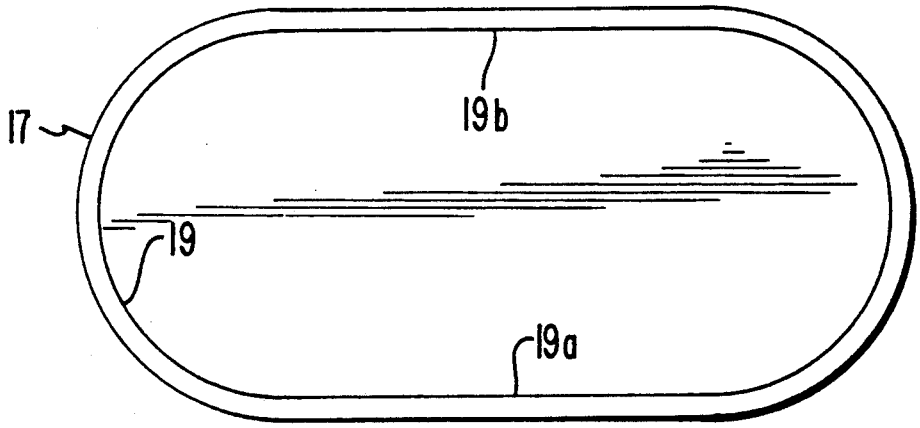
FIG. 5B is a top view of the container of FIG. 5A.
Figure 6A:
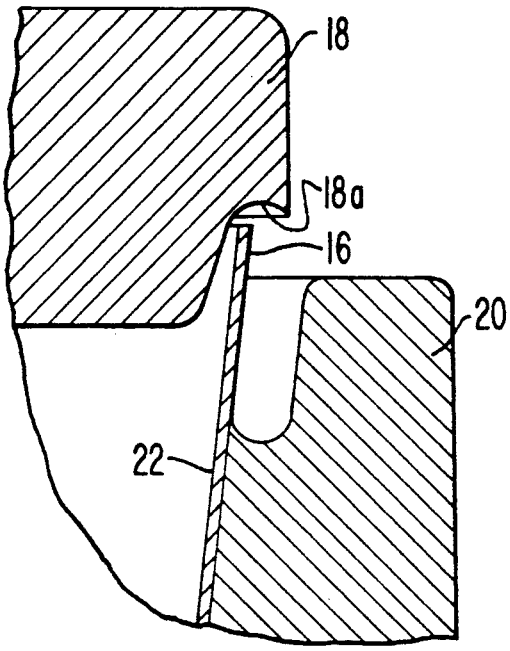
FIG. 6A PRIOR ART
FIGS. 6A and 6B are partial, cross-sectional views illustrating a brim curl process carried out on a container in accordance with the prior art.
Figure 6B:
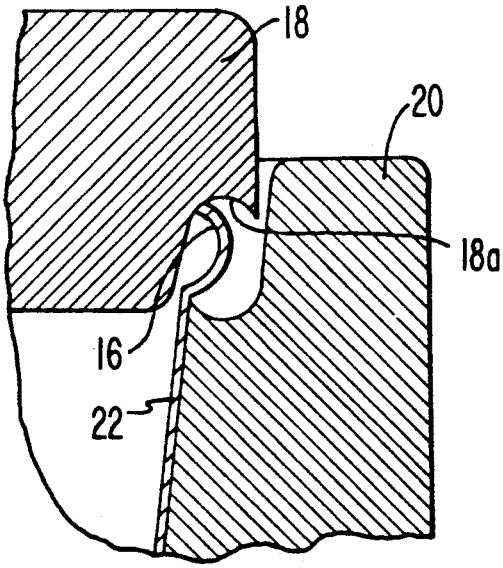
FIG. 6B PRIOR ART

In one aspect of the present invention, the blank cutting technique illustrated in FIG. 1 is used to form simultaneous with the cutting operation a precurl 13 (FIG. 2) at one end of a blank 15 for forming a paperboard container having a brim curl. In this embodiment, by providing pre-curl 13, formation of a final curl 17 (FIGS. 3–5) is greatly facilitated. Namely, in the present invention, known techniques such as those described in the Background of the Invention section of this application can be used for the final curling operation and the chance of buckling of blank 15 during the curling operation, e.g., due to friction with the dies or misalignment of the dies as illustrated in FIGS. 6A and 6B, is avoided. As a result, the brim curl forming operation is more reliably performed with less material waste. Also, a more complete curl can be obtained, especially when the container is an oblong container such as cannister 19 (FIG. 5) having linear edge portions 19*a* and 19*b*. In this case, the pre-curl contributes significantly to achieving a complete curl, e.g., of at least 360 degrees.

Figure 4A:
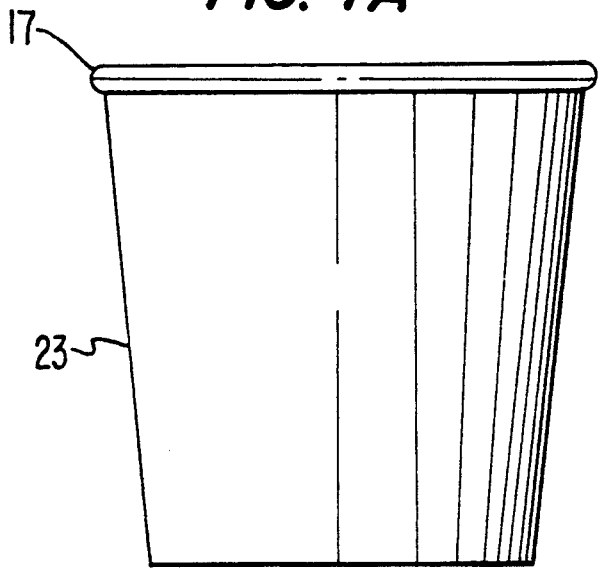
FIG. 4A is a frontal view of a container provided with a brim curl in accordance with the invention.
Figure 4B:
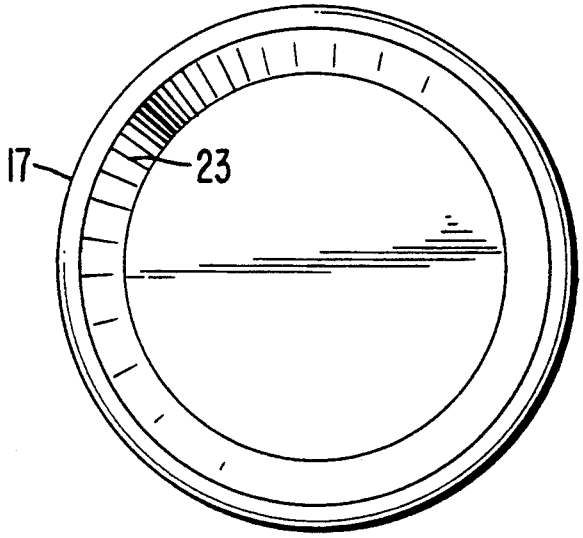
FIG. 4B is a top view of the container of FIG. 4A.

FIGS. 4A and 4B illustrate a typical cup 23 having a circular cross-section, a frustoconical shape and a brim curl 17 along the drinking edge. When the blank cutting technique illustrated in FIGS. 1A–1C are used to provide a pre-curl in a process of making a container such as illustrated in FIG. 4 or FIG. 5, the following process parameters have been found to be particularly suitable.

Applicant has found that it is desirable to space the cutting line 14; i.e. the cutting tool 3, from stepped portion 7 by a distance c equal to or slightly less than the thickness (caliper) a of stock material 11. Typically, paperboard suitable for making containers 19 and 23 is 16/1000ths of an inch thick. In this case, offset c should equal this value. It is also desirable to provide a counter material 5 having a thickness of 30 to 40/1000ths of an inch thick. Various counter thicknesses can be achieved by stacking a plurality of counter sheets of predetermined thickness to achieve the desired thickness.

The above parameters can be varied to obtain different results. For example, if a larger precurl 9 is desired, offset c and counter thickness b can be increased proportionately. If a larger brim curl 17 is to be provided on the container, it is desirable to provide a larger precurl 9 using this technique. Once the blank has been cut, the container is formed and the brim curl is completed as illustrated in FIGS. 7A and 7B.

As can be seen from FIGS. 6A and 6B, when forming a brim curl without a precurl, the end 16 of the formed container 22 will frictionally engage the die surface 18*a* of the upper die 18. This may result in buckling of the upper portion of the container 22 if it is not properly aligned or if the end 16 catches in the upper die 18 as the upper die 18 descends towards lower due 20, as illustrated in FIG. 6B.

Figure 7A:
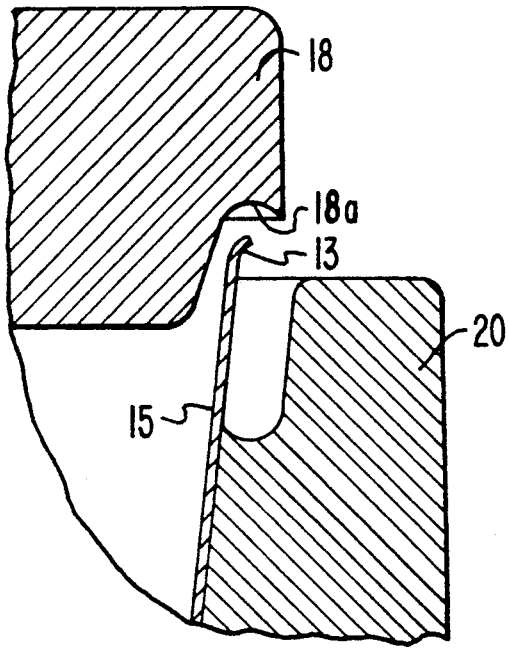
FIGS. 7A and 7B are partial, cross-sectional views illustrating the brim curl process carried out on a container in accordance with the present invention.
Figure 7B:
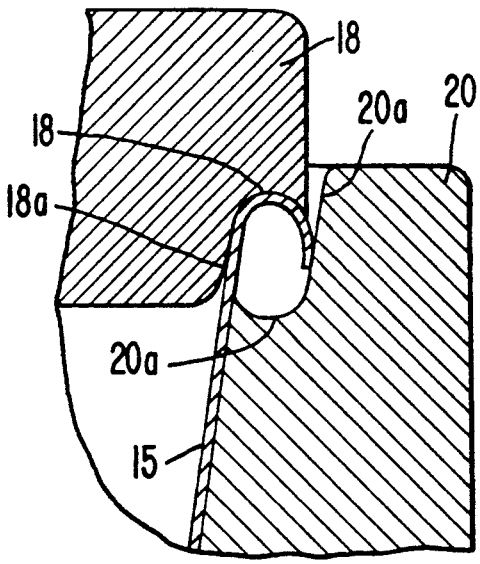

Referring now to FIGS. 7A and 7B, identical upper and lower dies 18 and 20 cooperate to form a brim curl on a container 15 having a precurl 13 about its upper periphery. As can be seen from FIG. 7A, the precurl 13 will contact the die surface 18*a* and be readily directed into a counter die surface 20*a* of die 20 for the final formation of the brim curl 17. By providing the precurl section 13, the brim curl is readily formed on the container without the fear of buckling and with less force being required by the die 18.

A second application of the blank cutting technique illustrated in FIG. 1 will now be described.

Figure 9A:
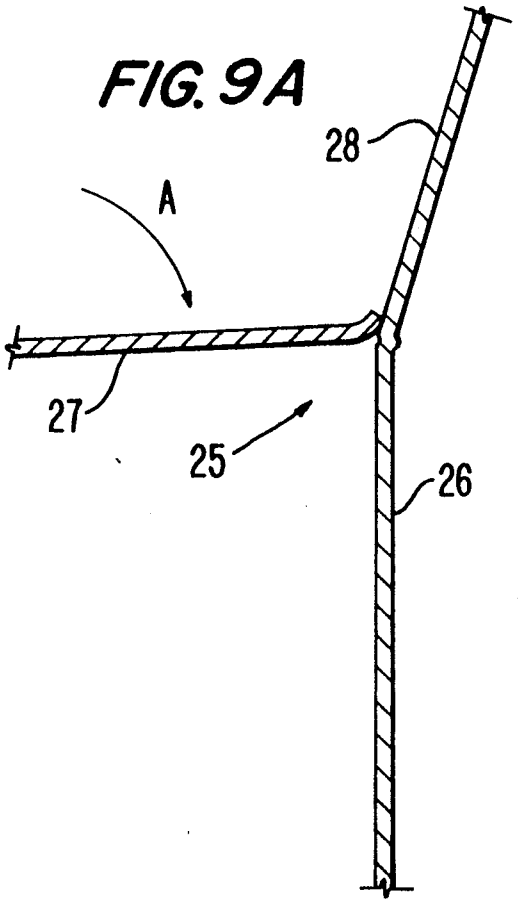
FIGS. 9A, 9B and 9C are partial, cross-sectional views of the closure flap of a carton formed in accordance with the present invention.
Figure 9B:
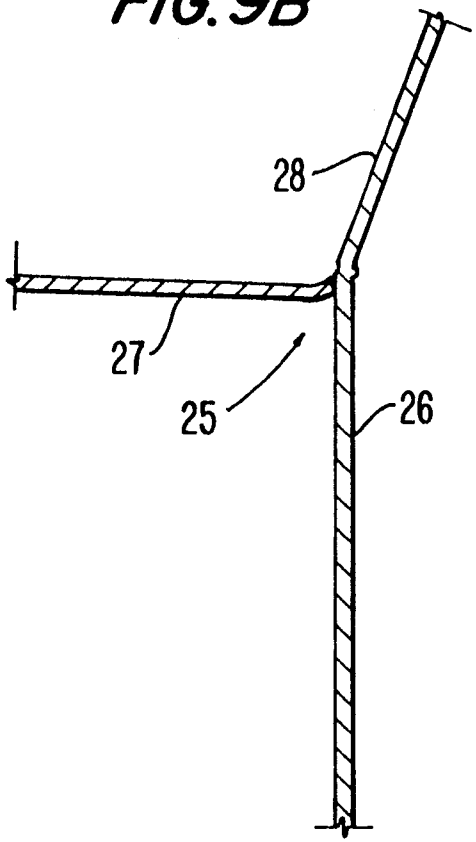
Figure 9C:
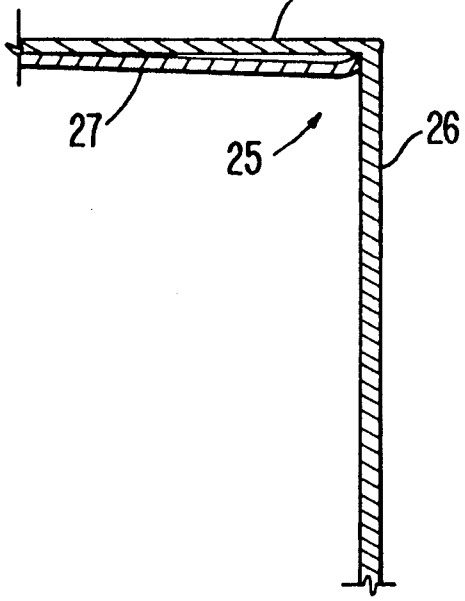

FIGS. 9A-9C illustrate a portion of a paperboard carton 25 in accordance with the present invention. This paperboard carton 25 and the blank for forming the same is, except as otherwise noted, of a known construction wherein a plurality of panels of the blank, defined by fold lines 24 provided by embossing or the like, form wall portions 26 of a box-shaped container. An end of carton 25 is adapted to be opened for removal of perishable contents such as ice cream or the like. Four flaps, two of which are illustrated 27 and 28, are hingedly connected along respective fold lines 24 defining edges of the wall portions 26. With conventional cartons, vertical flaps are provided with means for engaging with each other to secure the carton in a closed state. A tongue member provided on one of the flaps is insertable into a slit provided on the other of the flaps. Horizontally oriented flap 28 is abbreviated in size whereas horizontal flap 27 is sized to cover the entire open end of carton 25.

Figure 8B:
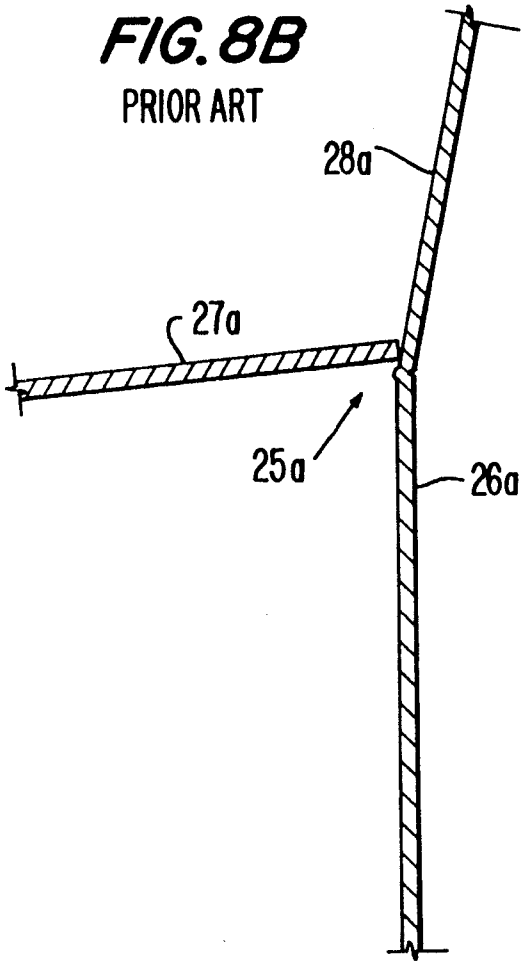
FIG. 8B PRIOR ART
FIGS. 8A and 8B are partial, cross-sectional views of the closure flaps of a carton formed in accordance with the prior art.
Figure 8A:
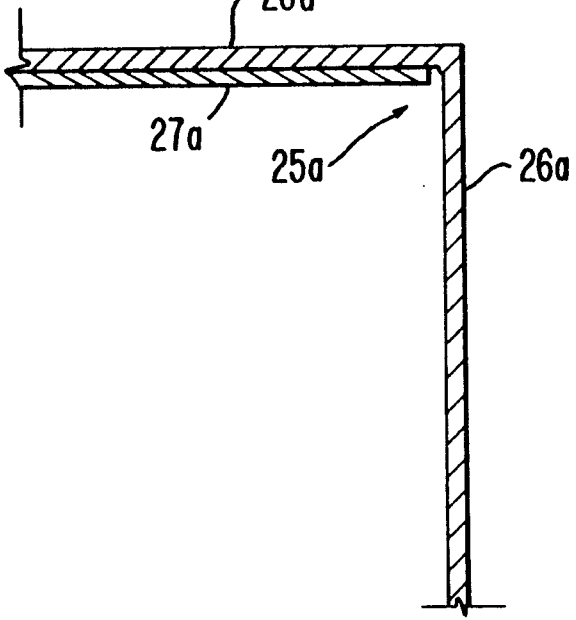
FIG. 8A PRIOR ART

With reference to FIGS. 8A and 8B, the open end of the prior art container 25*a* is illustrated as including side walls 26*a*, abbreviated flap 28*a* and flap 27*a*. As can be seen in FIG. 8A, the flap 27*a* may during the manufacturing of the blank fall short of side wall 26*a* which will result in the insufficient sealing of carton 25*a*. From FIG. 8B, it can be noted that flap 27*a* may be of a dimension greater than that of the carton opening which will then contact an inner portion of the abbreviated flap 28*a* and retard the closing of the container 25*a*.

Accordingly, by providing a flaired edge 35 on the flap 27 illustrated in FIGS. 9A-9C, this flap 27 may be readily inserted into the opening of the carton 25 and form a tight seal over the contents.

The flaps are closed in the following manner to seal the carton. First, flap 27 is pivoted in the direction of arrow A to a position just inside wall portions 26 against a food product such as ice cream which is filled to the edge of wall portions 26. Next, flap 28 is pivoted to a position overlying flap 27, and finally, the interlocking flaps are pivoted inwardly and engaged with each other to seal the carton.

In the carton of the present invention, during the blank forming process, the peripheral edge of flap 27 is cut using the technique illustrated in FIG. 1. Thereby, flaired edge 35 is created around the perimeter of flap 27 without an additional process step. Preferably, the flaired edge 35 is provided along each of the three unhinged sides of flap 27. Flaired edge 35 allows flap 27 to be fit more snugly within the end of the carton and creates a tighter seal of the carton as compared with a conventional flap without a flange. Flaired edge 35 allows flap 27 to be sized slightly larger than the internal dimensions of the end opening so that when flap 27 is pivoted into the container, the flaired edge 35 is resiliently biased inward by wall portions 26. In comparison, in the prior art illustrated in FIGS. 8A and 8B, it is necessary to size lid flap 27*a* slightly smaller than the internal dimensions of the container opening. Flaired edge 35 has an additional advantage of providing a lip which can be grasped by hand in order to facilitate opening of the carton 25. In contrast, in the prior art carton it is often necessary to dig into the carton contents with one's fingers to open the flap 27*a*.

Figure 11:
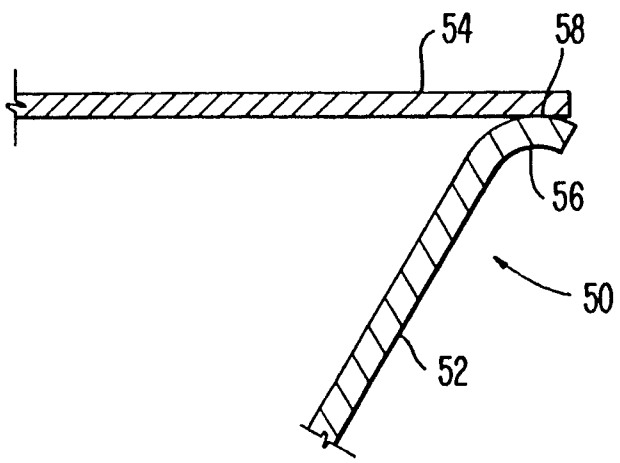
FIG. 11 is a partial, cross-sectional view of a sealed container formed in accordance with the present invention.
Figure 10:
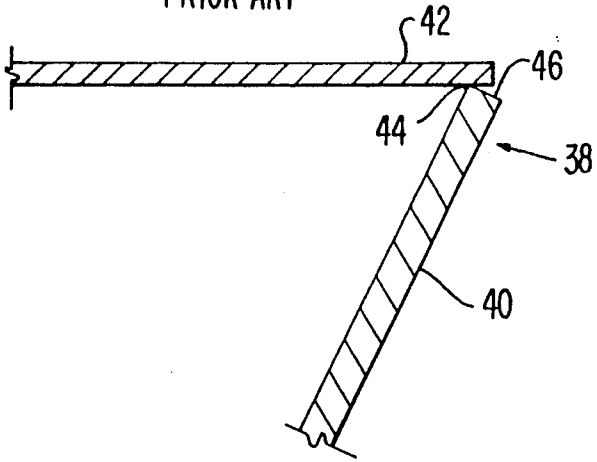
FIG. 10 PRIOR ART
FIG. 10 is a partial, cross-sectional view of a sealed container formed in accordance with the prior art.

In yet another aspect of the present invention, a working surface for the application of a closure may be formed about the periphery of a container as illustrated in FIG. 11. Referring initially to FIG. 10, a container 38 having side walls 40 includes a sealing membrane 42 which may be of a foil, transparent plastic or paperboard material is sealed at its contact with the side wall 40 in the region 44. With the prior art container 38, the surface at which the sealing of the membrane 42 may take place is extremely limited in that the only surface provided is the die cut edge 46 of the side wall 40.

Referring now to FIG. 11, a container 50 formed in accordance with the present invention is illustrated. The portion of the container side walls 52 where the sealing of a membrane 54 similar to that membrane 42 illustrated in FIG. 10 includes a flaired edge 56. This flaired edge 56 is formed in accordance with the process set forth in FIGS. 1A-1C. By providing such a flaired edge 56, a working surface 58 for the sealing of the membrane 54 is readily provided. In contrast to the prior art container 38, this working surface 58 provides a substantial edge for cooperating with a contact surface of a mechanical manipulating device for the sealing of the membrane 54 about the upper periphery of the container 50. By providing such a flaired edge 56, the membrane 54 may be readily and reliably sealed to the container 50.

As can be seen from the foregoing, by providing a flaired edge or precurl about the periphery of a portion of various containers will aid in the future manufacturing of resultant cartons, as well as the closure of a carton having a sealing flap formed in accordance with the present invention. Moreover, the various applications of the present invention will result in the elimination of multiple manufacturing steps, as well as the destruction of containers during subsequent manufacturing processes.

While the present invention has been described with reference to preferred embodiments, it will be appreciated by those skilled in the art that the invention may be practiced otherwise and as specifically described herein without departing from the spirit and scope of the invention. It is, therefore, to be understood that the spirit and scope of the invention be limited only by the appended claims.

INDUSTRIAL APPLICABILITY

Blanks for the manufacturing of various containers wherein a working surface or a surface to be subsequently maneuvered by various manufacturing processes may be formed to include a precurl or flaired edge in accordance with the present invention in order to aid in such subsequent manufacturing steps. Containers of this type would include, but are not limited to, drinking cups, containers have flexible lids snapped over a brim formed thereon, containers wherein the end flap effectively seals the opening of the container, containers having a membrane sealed about the periphery thereof and various other containers wherein it is desired to provide a precurled or flaired edge forming a working surface.

I claim:

1. A method of forming an unclosed container with an opening defined by an edge having a brim curl, comprising the steps of:

cutting from stock material a blank for the container in a manner so as to create a precurled portion along at least one edge thereof which will define the container opening;

forming the container from said blank to cause said precurl to be directed radially outwardly from said container opening; and performing a final curling operation on said precurled portion of the unclosed container to form a brim curl on said at least one edge along the container opening in a manner to leave the opening unclosed when the final curling operation is complete thereby forming the unclosed container.

2. A method of forming a container according to claim 1, wherein said stock material comprises paper.

3. A method of forming a container according to claim 2, wherein said container opening has a circular edge upon which the final curling is performed.

4. A method of forming a container according to claim 2, wherein said container opening comprises at least one linear edge portion upon which the final curling is performed.

5. A method of forming a container according to claim 4, wherein said container opening further comprises at least one arcuate edge portion and the final curling is also performed thereon.

6. A method of forming a container according to claim 1, wherein said cutting step is performed by:

creating a stepped portion on a die cutting bed;

positioning said stock material on the die cutting bed so that it extends across said stepped portion; and cutting the stock material with a cutting tool along a cutting line substantially parallel to said stepped portion and against a lower surface of the die cutting bed defined by the stepped portion, whereby a precurl is formed along an edge of the blank as the blank is cut.

7. A method of forming a container according to claim 6, wherein said stock material comprises paper.

8. A method of forming a container according to claim 7, wherein said cutting line is spaced from said stepped portion a distance not greater than a thickness of the stock material.

9. A method of forming a container according to claim 7, wherein said stepped portion comprises an edge surface extending perpendicularly between said lower surface of the die cutting bed and an upper counter surface of the die cutting bed, said edge surface having a height in the range of 30 to 40/1000ths of an inch.

10. A method of forming a container according to claim 6, wherein said stepped portion is created by placing at least one counter sheet of a predetermined thickness on said die cutting bed.

11. A method of making a blank for a closable paperboard carton having an opening, a closable lid and a flared edge formed on the closable lid, comprising the steps of:

cutting stock material to form a blank including a closable lid, said cutting step creating the flared edge along at least one edge portion of the blank; and forming fold lines in the blank for allowing the blank to be folded in such a manner to create the closable paperboard carton wherein said flared edge of said edge portion is integral with one edge of said closable lid and extends outwardly away from the carton interior when said closable lid is closed.

12. A method of making a blank according to claim 11, wherein the cutting step is performed by:

creating a stepped portion on a die cutting bed;

positioning said stock material on the die cutting bed so that it extends across said stepped portion; and cutting the stock material with a cutting tool along a cutting line substantially parallel to said stepped portion and against a lower surface of the die cutting bed defined by the stepped portion, whereby the outwardly flaired edge is formed as the blank is cut.

* * * * *